US009824803B2

(12) United States Patent
Fujinaka et al.

(10) Patent No.: US 9,824,803 B2
(45) Date of Patent: Nov. 21, 2017

(54) MAGNETIC REFRIGERATION MATERIAL AND MANUFACTURING METHOD OF MAGNETIC REFRIGERATION MATERIAL

(75) Inventors: Tomonori Fujinaka, Obu (JP); Nobuyoshi Sakakibara, Nishio (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 495 days.

(21) Appl. No.: 14/344,269

(22) PCT Filed: Sep. 12, 2012

(86) PCT No.: PCT/JP2012/005791
§ 371 (c)(1),
(2), (4) Date: Mar. 11, 2014

(87) PCT Pub. No.: WO2013/038662
PCT Pub. Date: Mar. 21, 2013

(65) Prior Publication Data

US 2014/0341773 A1 Nov. 20, 2014

(30) Foreign Application Priority Data

Sep. 14, 2011 (JP) ..... 2011-200630

(51) Int. Cl.

| | |
|---|---|
| ***H01F 1/01*** | (2006.01) |
| ***C22C 38/00*** | (2006.01) |
| ***F25B 21/00*** | (2006.01) |
| ***C22C 38/02*** | (2006.01) |

(Continued)

(52) U.S. Cl.
CPC ..... *H01F 1/015* (2013.01); *B22F 3/11* (2013.01); *C22C 33/02* (2013.01);
(Continued)

(58) Field of Classification Search
CPC ..... H01F 1/012; H01F 1/015; H01F 1/017; B22F 3/11; C22C 33/02; C22C 33/0278;
(Continued)

(56) References Cited

U.S. PATENT DOCUMENTS

2004/0194855 A1 10/2004 Fukamichi et al.
2004/0231338 A1* 11/2004 Saito ..... F25B 21/00 62/3.1

(Continued)

FOREIGN PATENT DOCUMENTS

JP 2003-096547 A 4/2003
JP 2005-036302 A 2/2005

(Continued)

OTHER PUBLICATIONS

Additional Machine Translation of JP 2005-036302 A.*

(Continued)

*Primary Examiner* — Jennifer A Smith
*Assistant Examiner* — Alexandra M Moore
(74) *Attorney, Agent, or Firm* — Harness, Dickey & Pierce, P.L.C.

(57) ABSTRACT

A magnetic refrigeration material includes an alloy represented by a composition formula of $La(Fe, Si)_{13}H$, and the alloy includes α-Fe by a weight ratio lower than 1 wt % and a plurality of pores so that a packing fraction of the alloy is within a range from 85% to 99%.

7 Claims, 7 Drawing Sheets

(51) Int. Cl.
*C22C 33/02* (2006.01)
*B22F 3/11* (2006.01)
*B22F 3/105* (2006.01)

(52) U.S. Cl.
CPC ..... *C22C 33/0278* (2013.01); *C22C 38/00* (2013.01); *C22C 38/002* (2013.01); *C22C 38/005* (2013.01); *C22C 38/02* (2013.01); *F25B 21/00* (2013.01); *B22F 2003/1051* (2013.01); *B22F 2202/06* (2013.01); *B22F 2202/13* (2013.01); *C22C 2202/02* (2013.01); *F25B 2321/002* (2013.01)

(58) Field of Classification Search
CPC ..... C22C 38/00; C22C 38/002; C22C 38/005; C22C 38/02; F25B 21/00
See application file for complete search history.

(56) References Cited

U.S. PATENT DOCUMENTS

| | | | |
|---|---|---|---|
| 2006/0076084 | A1 | 4/2006 | Nakajima |
| 2006/0254385 | A1 | 11/2006 | Tsuji et al. |
| 2008/0216484 | A1 | 9/2008 | Tsuji et al. |
| 2014/0127071 | A1 | 5/2014 | Fujinaka et al. |

FOREIGN PATENT DOCUMENTS

| | | | |
|---|---|---|---|
| JP | 2005-200749 | A | 7/2005 |
| JP | 2006-316324 | A | 11/2006 |
| JP | 3967572 | B2 | 8/2007 |
| JP | 2008-214733 | A | 9/2008 |
| JP | 4240380 | B2 | 3/2009 |

OTHER PUBLICATIONS

Office Action dated Mar. 31, 2015 in corresponding Chinese Application No. 201280044602.6.
International Search Report and Written Opinion of the ISA for PCT/JP2012/005791, ISA/JP, dated Nov. 27, 2012.
Office Action dated Feb. 12, 2014 issued in the corresponding JP application No. 2011-200630 with its English translation (5 pages).
Office Action dated Dec. 4, 2015 issued in the corresponding CN application No. 201280044602.6 in Chinese with English translation.

* cited by examiner (a)

(b)

(c)

(d)

| GRAIN DIAMETER / TEMPERATURE | 214 μm | 75 μm | 25 μm |
|---|---|---|---|
| 1100°C | ○ (FIRST EMBODIMENT) | ○ (FOURTH EMBODIMENT) | ○ (SIXTH EMBODIMENT) |
| 1000°C | ○ (SECOND EMBODIMENT) | ○ (FIFTH EMBODIMENT) | ○ (SEVENTH EMBODIMENT) |
| 950°C | ○ (THIRD EMBODIMENT) | × | × |
| 900°C | × (FIRST COMPARISON EXAMPLE) | × (SECOND COMPARISON EXAMPLE) | × (THIRD COMPARISON EXAMPLE) |

MAGNETIC REFRIGERATION MATERIAL AND MANUFACTURING METHOD OF MAGNETIC REFRIGERATION MATERIAL

CROSS REFERENCE TO RELATED APPLICATION

This application is a 371 U.S. National Phase of International Application PCT/JP2012/005791, filed Sep. 12, 2012, based on Japanese Patent Application No. 2011-200630 filed on Sep. 14, 2011, the disclosures of which are incorporated herein by reference.

TECHNICAL FIELD

The present disclosure relates to a magnetic refrigeration material used in a refrigerating cycle utilized in air conditioning, a refrigerating, and a freezing.

BACKGROUND ART

A research on a magnetic refrigerating technology that provides clean energy and has a high efficiency is proceeded as an environment-friendly refrigerating technology. The magnetic refrigeration material is a magnetic material that produces a magnetocaloric effect under externally applied magnetic field. As shown in patent literature 1, it is known that La(Fe, Si)$_{13}$ series material produces an improved magnetocaloric effect as a magnetic refrigeration material. In the magnetic refrigeration material disclosed in patent literature 1, it is known that a curie temperature of the magnetic refrigeration material changes by carrying out hydrogen absorption to the magnetic refrigeration material, and the magnetocaloric effect of the magnetic refrigeration material is produced at a room temperature.

As described above, when the hydrogen absorption is carried out to the La(Fe, Si)$_{13}$ material, a crystal lattice of the La(Fe, Si)$_{13}$ expands in volume and a dimension of the crystal lattice of the La(Fe, Si)$_{13}$ increases since hydrogen atoms are absorbed by the crystal lattice of the La(Fe, Si)$_{13}$. As a result, stress may be easily generated at a grain boundary and a boundary between different compositions. Accordingly, a crack may be easily generated in the material caused by the stress, and it may be difficult to restrict a generation of the crack.

The following will describe an example of a stress generation that causes the crack. La(Fe, Si)$_{13}$ material includes small amount of alpha iron ($\alpha$-Fe) that is generated during a sintering process. The sintering process is carried out in order to generate the crystal lattice in the La(Fe, Si)$_{13}$ material. FIG. 7(*a*) and FIG. 7(*b*) are schematic diagrams showing an enlarged cross-sectional view of a part of the magnetic refrigeration material. FIG. 7(*a*) shows the schematic diagram before a hydrogen absorption is carried out, and FIG. 7(*b*) shows the schematic diagram after the hydrogen absorption is carried out.

As shown in FIG. 7(*a*), before the hydrogen absorption is carried out, an $\alpha$-Fe portion 101 is contacted with a La(Fe, Si)$_{13}$ alloy portion 103. As shown in FIG. 7(*b*), after a hydrogen absorption for absorbing hydrogen 107 is carried out to the magnetic refrigeration material, the La(Fe, Si)$_{13}$ alloy portion 103 absorbs hydrogen and expands as a La(Fe, Si)$_{13}$H alloy portion 105. On the other hand, the $\alpha$-Fe portion 101 does not absorb hydrogen 107 and does not expand. As a result, a gap 109 is generated between the $\alpha$-Fe portion 101 and the La(Fe, Si)$_{13}$H alloy portion 105, and the gap causes the crack of the magnetic refrigeration material.

PRIOR ART LITERATURES

Patent Literature

[Patent Literature 1] JP 2003-96547 A

SUMMARY OF INVENTION

In view of the foregoing difficulties, it is an object of the present disclosure to provide a magnetic refrigeration material that restricts a generation of a crack and a manufacturing method of the magnetic refrigeration material with which a generation of a crack in the magnetic refrigeration material is restricted.

According to a first aspect of the present disclosure, a magnetic refrigeration material includes an alloy represented by a composition formula of La(Fe, Si)$_{13}$H. The alloy further includes $\alpha$-Fe by a weight ratio lower than 1 wt % and a plurality of pores so that a packing fraction of the alloy is within a range from 85% to 99%.

With the above magnetic refrigeration material, a generation of physical damage, such as a crack, can be restricted.

According to a second aspect of the present disclosure, a magnetic refrigeration material includes an alloy represented by a composition formula of La(Fe, Si)$_{13}$H. The alloy further includes $\alpha$-Fe by a weight ratio equal to or lower than 10 wt % and a plurality of pores so that a packing fraction of the alloy is within a range from 85% to 95%.

With the above magnetic refrigeration material, similar to the magnetic refrigeration material according to the first aspect of the present disclosure, a generation of a crack or the like can be restricted.

According to a third aspect of the present disclosure, a manufacturing method of a magnetic refrigeration material includes sintering a powder raw material represented by a composition formula of La(Fe, Si)$_{13}$ at a temperature within a range from 950° C. to 1200° C. by a spark plasma sintering method to generate a sintered body, and carrying out a hydrogen absorption to the sintered body after sintering the powder raw material. The sintered body has a packing fraction within a range from 85% to 99% and includes $\alpha$-Fe by a weight ratio lower than 1 wt %.

With the above manufacturing method, similar to the magnetic refrigeration material according to the first aspect of the present disclosure, a magnetic refrigeration material in which a generation of a crack or the like can be restricted is manufactured.

According to a fourth aspect of the present disclosure, a manufacturing method of a magnetic refrigeration material includes sintering a powder raw material represented by a composition formula of La(Fe, Si)$_{13}$ at a temperature within a range from 950° C. to 1100° C. by a spark plasma sintering method to generate a sintered body, and carrying out a hydrogen absorption to the sintered body after sintering the powder raw material. The sintered body has a packing fraction within a range from 85% to 95% and includes $\alpha$-Fe by a weight ratio within a range from 1 wt % to 10 wt %.

With the above manufacturing method, similar to the magnetic refrigeration material according to the second aspect of the present disclosure, a magnetic refrigeration material in which a generation of a crack or the like can be restricted is manufactured.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

The following will describe embodiments of the present disclosure with reference to the drawings.

<Manufacturing of Magnetic Refrigeration Material>

First Embodiment

Figure 1:
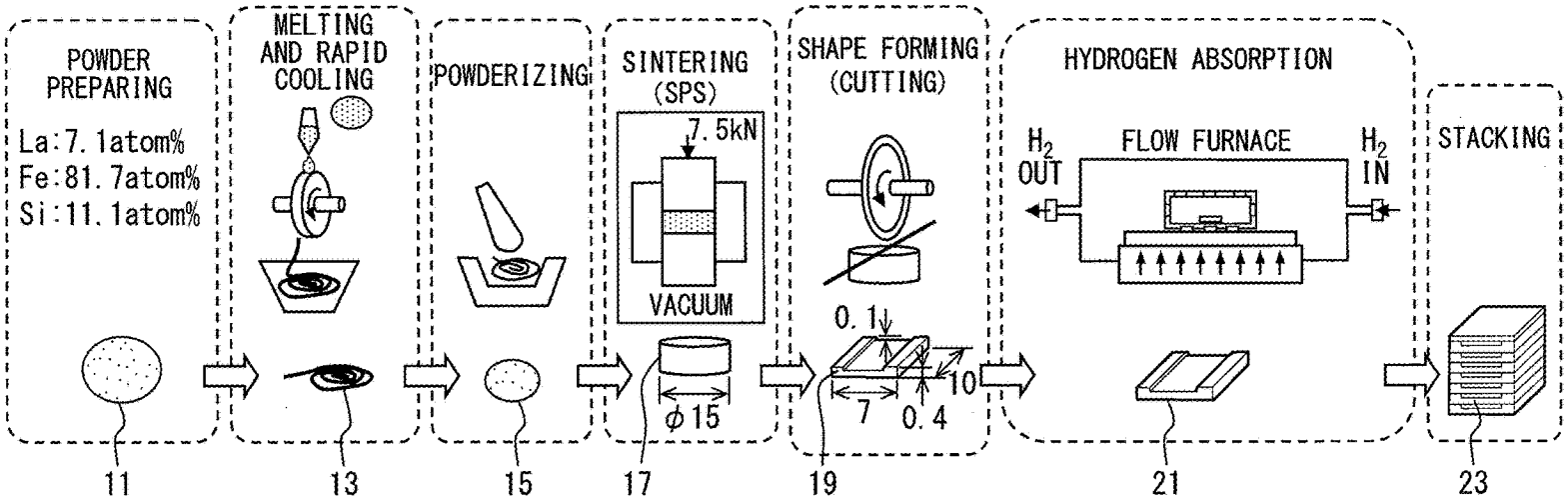
FIG. 1 is a diagram showing a manufacturing method of a microchannel heat exchanger.

In the present embodiment, the magnetic refrigeration material is manufactured, and a microchannel is manufactured with the magnetic refrigeration material. FIG. 1 shows a manufacturing process.

(1) Powder Preparing Process

A powder raw material 11 is obtained by mixing powder or bulk of multiple simple substances by a predetermined ratio. The following shows a composition example of the powder raw material 11.

La: 7.1 atom %

Fe: 81.7 atom %

Si: 11.1 atom %

(2) Melting and Rapid Cooling Process

A sheet 13 having a target crystal structure ($NaZn_{13}$ structure) is manufactured with a melting and rapid cooling method, such as a strip casting method, by the powder raw material 11 prepared in the powder preparing process.

(3) Powderizing Process

The sheet 13 is powderized, and fine powder 15 is obtained. In this process, powder having a grain diameter equal to or lower than 214 micrometers (μm) is used as the fine powder 15.

(4) Sintering Process

The fine powder 15 is pressurized and heated by spark plasma sintering (SPS) method, and a magnetic refrigeration material 17 having a predetermined bulk shape is formed. For example, the predetermined bulk shape is a tubular shape having a diameter of 15 millimeters (mm). Further, in the sintering process, a surface pressure applied to the material is approximately 42 MPa, and a sintering temperature is set to 1100° C.

The magnetic refrigeration material after performing the sintering, which is also referred to as a sintered body, has a packing fraction of 95%, and includes 2 weight percent (wt %) of alpha iron (α-Fe). The packing fraction is calculated by a formula (actually measured density/theoretical density)×100%, and theoretical density of the sintered body used in calculation is 7.2 gram per cubic centimeter ($g/cm^3$).

(5) Shape Forming Process

A material sheet 19 having a predetermined shape is formed by cutting, grinding, and polishing the magnetic refrigeration material 17 having the bulk shape. The predetermined shape of the material sheet 19 may be a rectangular plate shape, which has dimensions of 7 mm×10 mm and has a thickness of 0.4 mm, and the material sheet 19 has a groove having a depth of 0.1 mm.

(6) Hydrogen Absorbing Process

A hydrogen absorption is carried out to the material sheet 19 by heating the material sheet 19 to a temperature within a range from 180~300° C. in a hydrogen furnace, such as a flow furnace. Thus, a magnetic refrigeration material sheet 21 storing hydrogen is manufactured. Further, amount of hydrogen stored in the magnetic refrigeration material sheet 21 by the hydrogen absorption may be controlled by controlling a heating temperature.

(7) Stacking Process

The refrigeration material sheet 21 is stacked on one another by hot press in order to manufacture a microchannel heat exchanger 23, and the groove provides the micro channel. Further, the refrigeration material sheet 21 stacked on top has no groove.

As described above, the microchannel heat exchanger is manufactured from the magnetic refrigeration material by the powder preparing process, the melting and rapid cooling process, the powderizing process, the sintering process, the shape forming process, the hydrogen absorbing process, and the stacking process.

Second Embodiment

The microchannel heat exchanger is manufactured by a method basically similar to a method according to the first embodiment except that the sintering temperature in the sintering process is set to 1000° C.

After the sintering, the packing fraction of the magnetic refrigeration material is 90%, and the weight ratio of α-Fe is 2 wt %.

Third Embodiment

The microchannel heat exchanger is manufactured by a method basically similar to the method according to the first embodiment except that the sintering temperature in the sintering process is set to 950° C.

After the sintering, the packing fraction of the magnetic refrigeration material is 85%, and the weight ratio of α-Fe is 2 wt %.

Fourth Embodiment

The microchannel heat exchanger is manufactured by a method basically similar to the method according to the first embodiment except that an average grain diameter in the powderizing process is set to 75 μm.

After the sintering, the packing fraction of the magnetic refrigeration material is 93%, and the weight ratio of α-Fe is 2 wt %.

Fifth Embodiment

The microchannel heat exchanger is manufactured by a method basically similar to the method according to the first embodiment except that the powder having an average grain diameter equal to or smaller than 75 μm is used after the powdering process and the sintering temperature in the sintering process is set to 1000° C.

After the sintering, the packing fraction of the magnetic refrigeration material is 89%, and the weight ratio of α-Fe is 2 wt %.

Sixth Embodiment

The microchannel heat exchanger is manufactured by a method basically similar to the method according to the first embodiment except that an average grain diameter in the powderizing process is set to 25 μm.

After the sintering, the packing fraction of the magnetic refrigeration material is 92%, and the weight ratio of α-Fe is 2 wt %.

Seventh Embodiment

The microchannel heat exchanger is manufactured by a method basically similar to the method according to the first embodiment except that an average grain diameter in the powderizing process is set to 25 μm and the sintering temperature in the sintering process is set to 1000° C.

After the sintering, the packing fraction of the magnetic refrigeration material is 85%, and the weight ratio of α-Fe is 2 wt %.

FIRST COMPARISON EXAMPLE

The microchannel heat exchanger is manufactured by a method basically similar to the method according to the first embodiment except that the sintering temperature in the sintering process is set to 900° C.

After the sintering, the packing fraction of the magnetic refrigeration material is 82%, and the weight ratio of α-Fe is 2 wt %.

Further, in the shape forming process, when the sintered magnetic refrigeration material is cut into slices to have a thickness of 0.5 mm, the refrigeration material is break up into fragments. As a result, a shape forming of the plate having a thickness of 0.4 mm ends in failure, and a manufacturing of the microchannel heat exchanger ends in failure.

SECOND COMPARISON EXAMPLE

The microchannel heat exchanger is manufactured by a method basically similar to the method according to the first embodiment except that the powder having an average grain diameter equal to or smaller than 75 μm is used after the powdering process and the sintering temperature in the sintering process is set to 900° C.

After the sintering, the packing fraction of the magnetic refrigeration material is 77%, and the weight ratio of α-Fe is 2 wt %.

Further, in the shape forming process, when the sintered magnetic refrigeration material is cut into slices to have a thickness of 0.5 mm, the refrigeration material is break up into fragments. As a result, a shape forming of the plate having a thickness of 0.4 mm ends in failure, and a manufacturing of the microchannel heat exchanger ends in failure.

THIRD COMPARISON EXAMPLE

The microchannel heat exchanger is manufactured by a method basically similar to the method according to the first embodiment except that the powder having an average grain diameter equal to or smaller than 25 μm is used after the powdering process and the sintering temperature in the sintering process is set to 900° C.

After the sintering, the packing fraction of the magnetic refrigeration material is 73%, and the weight ratio of α-Fe is 2 wt %.

Further, in the shape forming process, when the sintered magnetic refrigeration material is cut into slices to have a thickness of 0.5 mm, the refrigeration material is break up into fragments. As a result, a shape forming of the plate having a thickness of 0.4 mm ends in failure, and a manufacturing of the microchannel heat exchanger ends in failure.

<Evaluation of Manufacturing Method>

Figure 2:
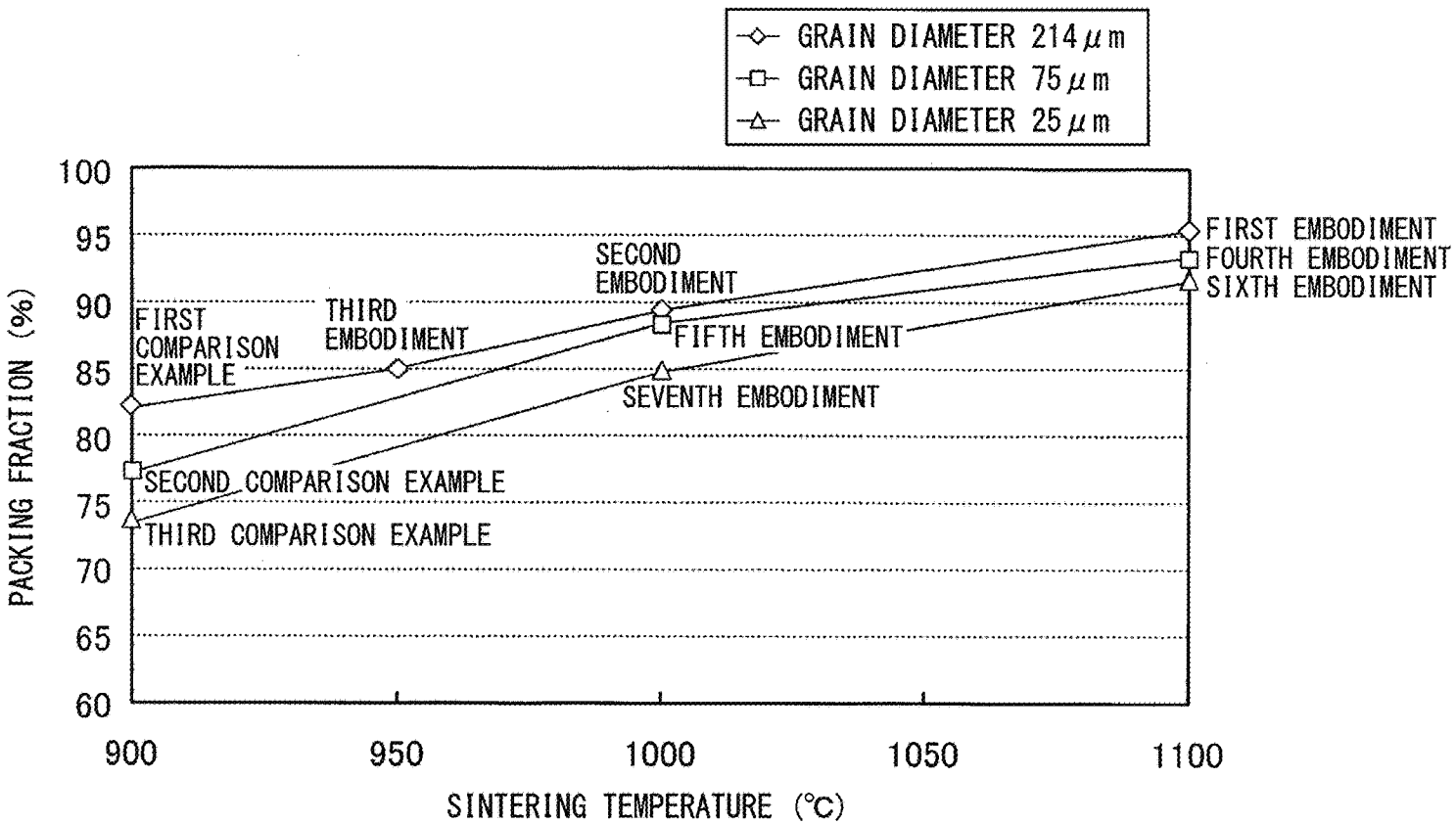
FIG. 2 is a graph showing a relationship between a sintering temperature and a packing fraction.

A relationship between the sintering temperature and the packing fraction in the first embodiment to the seventh embodiment and the first comparison example to the third comparison example is shown in FIG. 2.

As the graph indicates, the packing fraction increases with an increase of the sintering temperature. Further, the packing fraction increases with an increase of the average grain diameter during the sintering.

Figures 7, 8:
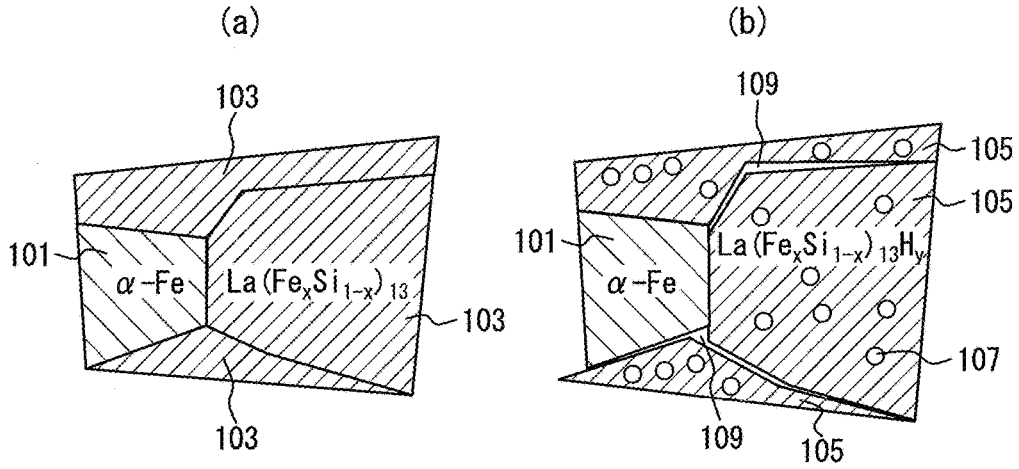
FIG. 7(*a*) is a cross-sectional view of the magnetic refrigeration material before the hydrogen absorption is carried out, and FIG. 7(*b*) is a cross-sectional view of the magnetic refrigeration material after the hydrogen absorption is carried out.
FIG. 8 is a diagram showing a process capability of the magnetic refrigeration material in a shape forming process under different process conditions.

FIG. 8 shows a capability of the shape forming process of the magnetic refrigeration material in the first embodiment to the seventh embodiment and the first comparison example to the third comparison example.

As shown in FIG. 8, the magnetic refrigeration material having the packing fraction equal to or higher than 85%, such as in the third embodiment and the seventh embodiment, is capable of cutting into slices to have a thickness of 0.4 mm, and the microchannel heat exchanger can be manufactured. The magnetic refrigeration material in the first embodiment, second embodiment, fourth embodiment to sixth embodiment having the packing fraction higher than the 85% is similar to the magnetic refrigeration material in the third embodiment and the seventh embodiment.

On the other hand, in the first comparison, the magnetic refrigeration material having the packing fraction of approximately 82% fails to be sliced to have a thickness of equal to or thinner than 0.5 mm, and the manufacturing of the microchannel heat exchanger ends in failure. Further, in the second and third comparison examples, the magnetic refrigeration material fails to be sliced to have the thickness of equal to or thinner than 0.5 mm, and the manufacturing of the microchannel heat exchanger ends in failure.

Figure 3:
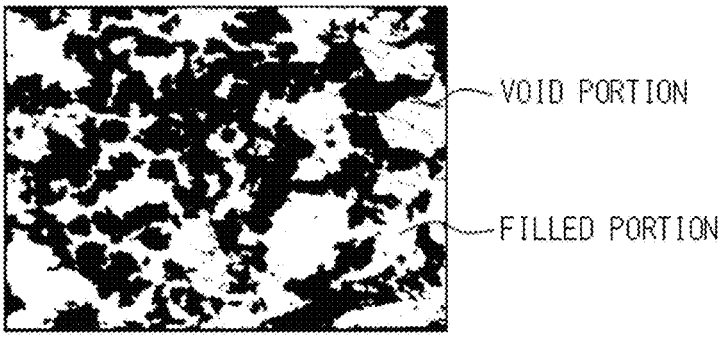
FIG. 3(*a*) is a photograph showing a cross-sectional view of a magnetic refrigeration according to a third embodiment, FIG. 3(*b*) is an outline figure of the photograph shown in FIG. 3(*a*), FIG. 3(*c*) is a photograph showing a cross-sectional view of a magnetic refrigeration according to a first comparison example, and FIG. 3(*d*) is an outline figure of the photograph shown in FIG. 3(*c*)
Figure 3:
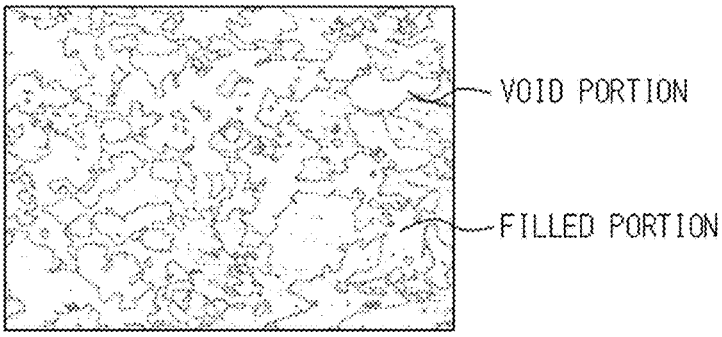
Figure 3:
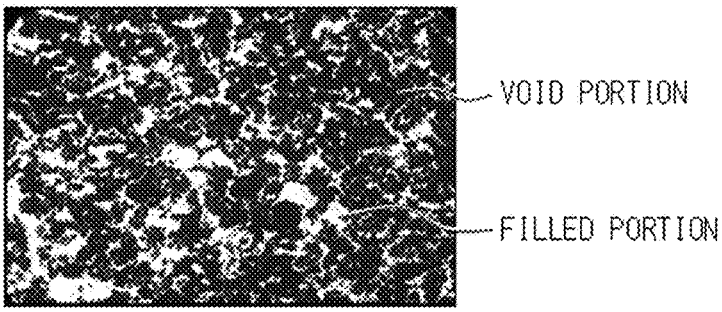
Figure 3:
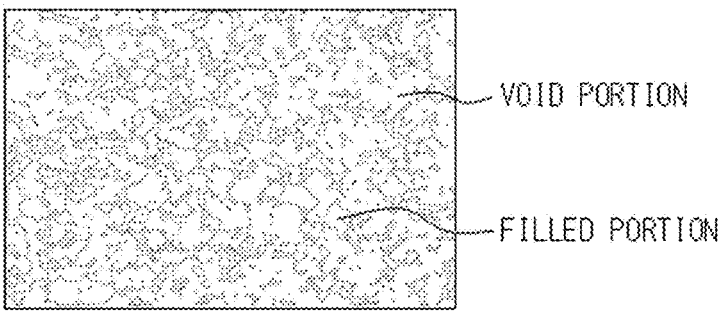

That is, a favorable packing fraction is equal to or higher than 85% in order to achieve a good processability. FIG. 3(*a*) and FIG. 3(*b*) show a cross-sectional view of the magnetic refrigeration material according to the third embodiment, and FIG. 3(*c*) and FIG. 3(*d*) show a cross-sectional view of the magnetic refrigeration material according to the first comparison example. Each of the magnetic refrigeration material includes a filled portion in which the material is filled (the material exists) and a void portion. The void portion is provided by multiple micro pores. Further, in the third embodiment and in the first comparison example, a porosity after performing an image processing (binarizing process) is 45.2% and 36%, respectively.

Figure 4:
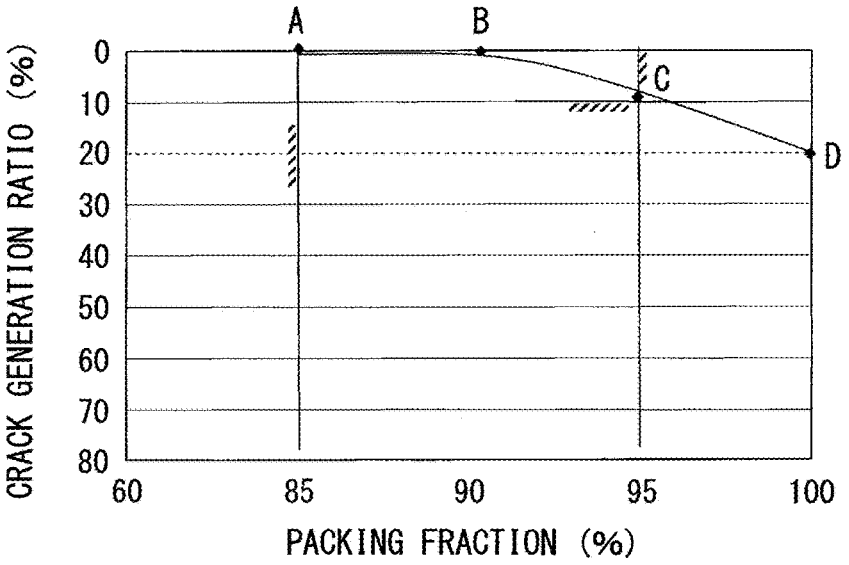
FIG. 4 is a graph showing a relationship between the packing fraction and a crack generation ratio.

FIG. 4 is a graph showing a relationship between the packing fraction and a crack generation ratio after the hydrogen absorption is carried out to the magnetic refrigeration material. The graph shows a result of the magnetic refrigeration material including α-Fe by 2 wt %. Whether a crack generated or not is determined by determining whether the material sheet 19 is divided into two or more pieces during the hydrogen absorption.

Figure 5:
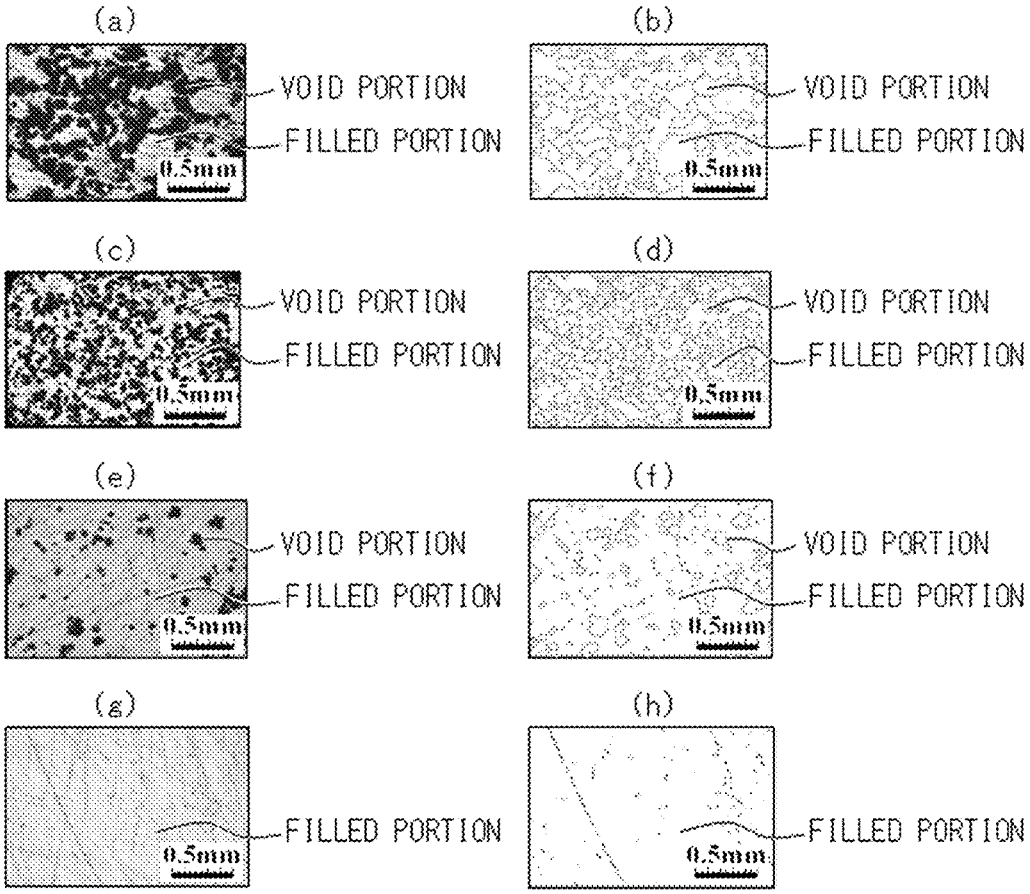
FIG. 5(*a*) is a photograph showing a cross-sectional view of a magnetic refrigeration material at a point A in FIG. 4, FIG. 5(*b*) is an outline figure of the photograph shown in FIG. 5(*a*), FIG. 5(*c*) is a photograph showing a cross-sectional view of the magnetic refrigeration material at a point B in FIG. 4, FIG. 5(*d*) is an outline figure of the photograph shown in FIG. 5(*c*), FIG. 5(*e*) is a photograph showing a cross-sectional view of the magnetic refrigeration material at a point C in FIG. 4, FIG. 5(*f*) is an outline figure of the photograph shown in FIG. 5(*e*), FIG. 5(*g*) is a photograph showing a cross-sectional view of the magnetic refrigeration material at a point D in FIG. 4, and FIG. 5(*h*) is an outline figure of the photograph shown in FIG. 5(*g*)

FIG. 5(*a*), FIG. 5(*c*), FIG. 5(*e*), FIG. 5(*g*) show the cross-sectional views of the magnetic refrigeration materials when the packing fractions of the magnetic refrigeration materials are 85%, 90%, 95%, and 100%, respectively. FIG. 5(*b*), FIG. 5(*d*), FIG. 5(*f*), FIG. 5(*h*) are diagrams showing outline figures of FIG. 5(*a*), FIG. 5(*c*), FIG. 5(*e*), FIG. 5(*g*). As shown in FIG. 5(*a*), a maximum dimension of the pore is about 200 μm when the packing fraction is 85%. It is similar to the magnetic refrigeration material manufactured in the third embodiment. Further, as shown in FIG. 5(*c*), a maximum dimension of the pore is about 100 μm when the packing fraction is 90%. It is similar to the magnetic refrigeration material manufactured in the second embodiment. Further, as shown in FIG. 5(*e*), a maximum dimension of the pore is about 100 μm when the packing fraction is 95%. It is similar to the magnetic refrigeration material manufactured in the first embodiment. Further, in the magnetic refrigeration material manufactured in the first comparison example, the packing fraction is 82% and a maximum dimension of the pore is about 300 μm. Further, when a size of the pore is smaller than 1 pm, the pore is not large enough to relax a stress, and when the size of the pore is larger than 200 μm, a shape forming becomes difficulty caused by a break of the shape during a mechanical process. Thus, when the maximum dimension of the pore is within a range from 1 to 200 μm, a good processability and a good cracking resistance are obtained.

As a graph shown in FIG. 4 indicates, under a condition that the weight ratio of α-Fe is 2 wt %, the crack generation ratio becomes higher than 10% when the packing fraction increases higher than 95%, but the crack generation ratio can be maintained equal to or lower than 10% when the packing fraction is equal to or lower than 95%. Further, the crack mostly disappears when the packing fraction is equal to or lower than 90%.

Accordingly, in order to increase the processability and restrict the generation of the crack, the favorable packing fraction is within a range from 85% to 95% when the weight ratio of α-Fe is 2 wt %. When the packing fraction is within a range from 85% to 90%, the generation of the crack is further reduced.

Further, a test is carried out to a magnetic refrigeration material including α-Fe by equal to or lower than 10 wt %, and a similar result to the magnetic refrigeration material including α-Fe by 2 wt % is obtained. The crack generation ratio increases when the magnetic refrigeration material includes α-Fe by higher than 10 wt %. That is, when α-Fe is included by equal to or lower than 10 wt %, the favorable packing fraction is 85% to 95%.

Further, a test is carried out to a magnetic refrigeration material including α-Fe by lower than 1 wt %, and the crack generation ratio is restricted equal to or lower than 10% even when the packing fraction is 99%. Accordingly, when α-Fe is included by lower than 1 wt %, the crack generation ratio is reduced within a wide range of the packing fraction from 85% to 99%. Further, when the packing fraction is higher than 99% and is close to 100%, the crack generation ratio increases higher than 10%.

Further, when the magnetic refrigeration material includes α-Fe by a weight ratio within a range from 1 wt % to 10 wt %, the packing fraction may be set 85% to 95%. The weight ratio of α-Fe can be adjusted by adjusting a condition of the powder preparing process and a condition of the melting and rapid cooling process.

<Relationship Between Sintering Temperature and Packing Fraction>

Figure 6:
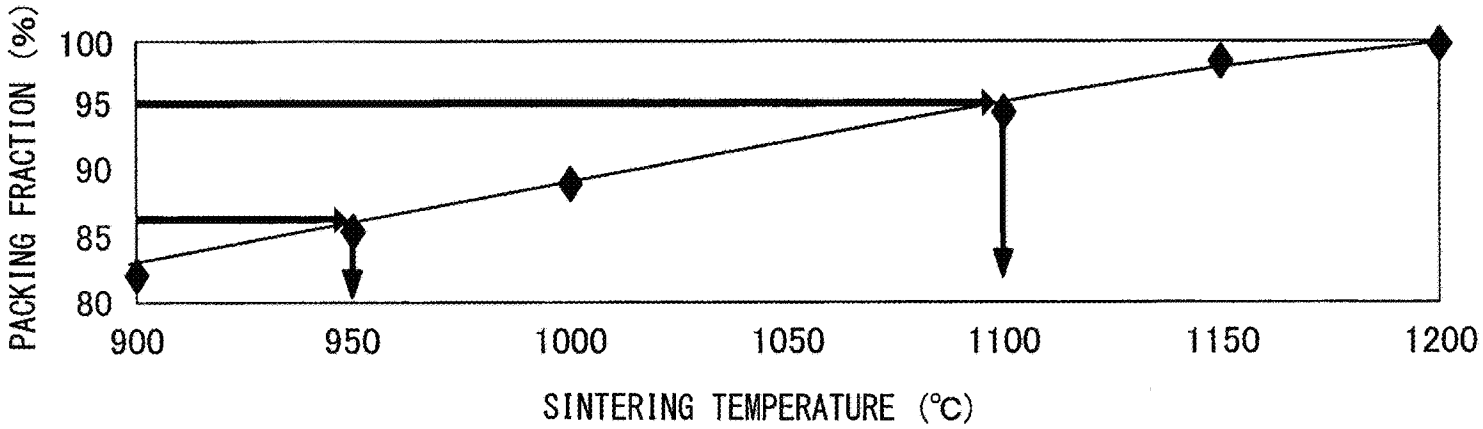
FIG. 6 is a graph showing a relationship between a sintering temperature and a packing fraction.

Further, a test is carried out and a relationship between the sintering temperature and the packing fraction shown in a graph of FIG. 6 is obtained. The graph shows a result when the weight ratio of α-Fe is 2 wt %.

When the sintering temperature is 950° C., the packing fraction is about 85%, and when the sintering temperature is 1200° C., the packing fraction is about 99%. Thus, the predetermined packing fraction can be controlled by setting the sintering temperature within a range from 950° C. to 1200° C. Further, when the sintering temperature is set 1100° C., the packing fraction is about 95%. Thus, the sintering temperature may be set within a range from 950° C. to 1100° C. in order to control the packing fraction within a range from 85% to 95%.

When the packing fraction is controlled, the density accordingly changes within a range from 6.0 g/cm$^3$ to 7.2 g/cm$^3$.

[Modification]

While the disclosure has been described with reference to embodiments thereof, it is to be understood that the disclosure is not limited to the described embodiments and constructions. The disclosure is intended to cover various modification and equivalent arrangements.

For example, in the foregoing embodiments, the manufacturing method of the microchannel heat exchanger, the manufacturing method of the magnetic refrigeration material, the method of hydrogen absorption are not limited to the examples described in the foregoing embodiments, and can be suitably changed or adjusted. For example, the composition of the raw material of the magnetic refrigeration material is not limited to the example described in the foregoing embodiments, and can be suitably changed or adjusted.

Further, a shape of the microchannel heat exchanger is not limited to the example described in the foregoing embodiments. Further, in the foregoing embodiments, the material sheets are stacked by the hot press. Further, the material sheets may be stacked by an adhesion material or stacked by a different method.

The present disclosure includes the following aspects.

According to a first aspect of the present disclosure, a magnetic refrigeration material includes alloy represented by a composition formula of $La(Fe, Si)_{13}H$, and the alloy further includes α-Fe by a weight ratio lower than 1 wt % and pores so that a packing fraction of the alloy is within a range from 85% to 99%

With the above-described magnetic refrigeration material, a generation of a physical damage, such as a crack, is restricted. Specifically, in the above-described magnetic refrigeration material, the packing fraction of a crystal of the material is reduced in order to form the pores. Thus, when the hydrogen absorption is carried out, a distortion caused by the hydrogen absorption can be released via the pores and stress is relaxed. Thus, a generation of the physical damage is restricted.

When the packing fraction of the magnetic refrigeration material is equal to or higher than 85%, the magnetic refrigeration material is restricted from becoming fragile. Thus, when a mechanical process is carried out to the magnetic refrigeration material, the magnetic refrigeration material hardly breaks, and processability is improved. Further, when the packing fraction is equal to or lower than 99%, the magnetic refrigeration material has enough pores, and a generation of a crack or the like is restricted.

Further, the weight ratio α-Fe (ferrite phase) included in the magnetic refrigeration material is set to a low value. When the hydrogen absorption is carried out to the magnetic refrigeration material, a crack is generated between α-Fe and a surrounding of α-Fe since α-Fe has a different increasing behavior of volume from $La(Fe, Si)_{13}H$ alloy arranged around α-Fe. By setting the weight ratio of α-Fe included in the magnetic refrigeration material to the low value, a generation of a crack is restricted.

Further, the generation of crack caused by α-Fe is effectively restricted by setting the weight ratio of α-Fe lower than 1 wt %, and the generation of crack can be satisfactorily restricted even when the packing fraction of the magnetic refrigeration material is increased to 99%.

According to a second aspect of the present disclosure, a magnetic refrigeration material includes alloy represented by a composition formula of $La(Fe, Si)_{13}H$, and the alloy further includes α-Fe by a weight ratio equal to or lower than 10 wt % and pores so that a packing fraction of the alloy is within a range from 85% to 95%.

With this magnetic refrigeration material, the generation of crack or the like is restricted similar to the magnetic refrigeration material according to the first aspect of the present disclosure. Further, in the magnetic refrigeration material according to the second aspect, the weight ratio of α-Fe is higher than the weight ratio of α-Fe in the first aspect. However, the generation of crack is effectively restricted by controlling the packing fraction equal to or lower than 95%. Further, since α-Fe can be included in the magnetic refrigeration material by a relatively high weight ratio, a degree of freedom in the manufacturing, such as the sintering temperature or a material shape during the sintering, is increased and the magnetic refrigeration material can be easily manufactured.

Further, the packing fraction is obtained by dividing an actually measured density by a theoretical density.

Further, the maximum dimension of the pore included in the magnetic refrigeration material according to the first aspect and the second aspect are within a range from 1 μm to 200 μm. By setting the maximum dimension of the pore equal to or greater than 1 μm, an improved stress relaxation performance can be obtained. Further, by setting the maximum dimension of the pore equal to or smaller than 200 μm, the magnetic refrigeration material is restricted from becoming fragile. Thus, generation of crack can be further restricted by setting the maximum dimension of the pore within the above-described range.

In the present disclosure, the pore is a micro void portion formed in a region sufficiently filled with the material. When the magnetic refrigeration material is viewed as a whole, a vacancy having a dimension larger than 200 μm may be partially included in the magnetic refrigeration material.

According to a third aspect of the present disclosure, a manufacturing method of the magnetic refrigeration material includes sintering a powder raw material represented by a composition formula of $La(Fe, Si)_{13}$ at a temperature within a range from 950° C. to 1200° C. by a spark plasma sintering method and carrying out a hydrogen absorption to the sintered body after the sintering of the powder raw material is carried out. Further, the sintered body formed by the sintering has a packing fraction within a range from 85% to 99% and includes α-Fe by lower than 1 wt %.

In the magnetic refrigeration material manufactured by the above-described method, generation of crack or the like is restricted similar to the magnetic refrigeration material according to the first aspect of the present disclosure.

According to a fourth aspect of the present disclosure, a manufacturing method of the magnetic refrigeration material includes sintering a powder raw material represented by a composition formula of $La(Fe, Si)_{13}$ at a temperature within a range from 950° C. to 1100° C. by a spark plasma sintering method and carrying out a hydrogen absorption to the sintered body after the sintering of the powder raw material is carried out. Further, the sintered body formed by the sintering has a packing fraction within a range from 85% to 95% and includes α-Fe by a weight ratio within a range from 1 wt % to 10 wt %.

In the magnetic refrigeration material manufactured by the above-described method, generation of crack or the like is restricted similar to the magnetic refrigeration material according to the second aspect of the present disclosure.

While the disclosure has been described with reference to preferred embodiments thereof, it is to be understood that the disclosure is not limited to the preferred embodiments and constructions. The disclosure is intended to cover various modification and equivalent arrangements. In addition, while the various combinations and configurations, which are preferred, other combinations and configurations, including more, less or only a single element, are also within the spirit and scope of the disclosure.

What is claimed is:

1. A magnetic refrigeration material comprising:

an alloy represented by a composition formula of $La(Fe, Si)_{13}H$, wherein the alloy further includes α-Fe by a weight ratio lower than 1 wt % and a plurality of pores so that a packing fraction of the alloy is within a range from 85% to 99%, and wherein a maximum dimension of each of the plurality of pores is within a range from 1 μm to 200 μm, and wherein the packing fraction is based on an actually measured density and a theoretical density of the alloy, and wherein the packing fraction increases as an average grain diameter increases, and wherein the alloy is made of a fine powder having a $NaZn_{13}$ crystal structure and a grain diameter equal to or lower than 214 micrometers, the fine powder prepared by:

combining La, Fe, and Si at respective predetermined ratios;

melting and rapidly cooling the powder raw material to obtain a sheet having the $NaZn_{13}$ crystal structure; and powderizing the sheet to obtain the fine powder.

2. A manufacturing method of the magnetic refrigeration material of claim 1 comprising:

preparing powder raw material by combining La, Fe, and Si at respective predetermined ratios;

melting and rapidly cooling the powder raw material to obtain a sheet having a $NaZn_{13}$ crystal structure;

powderizing the sheet to obtain a fine powder having the $NaZn_{13}$ crystal structure and a grain diameter equal to or lower than 214 micrometers;

sintering the fine powder represented by a composition formula of $La(Fe, Si)_{13}$ at a temperature within a range from 950° C. to 1200° C. by a spark plasma sintering method to generate a sintered body; and carrying out a hydrogen absorption to the sintered body after sintering the fine powder;

wherein the sintered body has a packing fraction within a range from 85% to 99% and includes α-Fe by a weight ratio lower than 1 wt %, wherein the packing fraction is based on an actually measured density and a theoretical density of the sintered body, and wherein the packing fraction increases as an average grain diameter increases.

3. The magnetic refrigeration material according to claim 1, wherein a generation of a crack can be restricted by the packing fraction being within the range of 85% to 99% and the α-Fe weight ratio being lower than 1 wt %.

4. The manufacturing method according to claim 2, wherein a difference in a degree of expansion by the absorption of hydrogen between the $La(Fe, Si)_{13}H$ and the α-Fe restricts a generation of a crack.

5. The manufacturing method according to claim 2, wherein the average grain diameter is equal to or less than 214 micrometers.

6. The magnetic refrigeration material according to claim 1, wherein a sintering temperature is in a range between 950° C. and 1200° C.

7. The manufacturing method according to claim 5, wherein a difference in a degree of expansion by the absorption of hydrogen between the $La(Fe, Si)_{13}H$ and the α-Fe restricts a generation of a crack.

* * * * *